US009718575B2

(12) United States Patent
Bourdin

(10) Patent No.: US 9,718,575 B2
(45) Date of Patent: Aug. 1, 2017

(54) TRAY MADE FROM CARDBOARD SHEET MATERIAL FOR MANUAL ASSEMBLY AND BLANK FOR PRODUCING SUCH A TRAY

(71) Applicant: OTOR, Puteaux (FR)

(72) Inventor: Olivier Bourdin, Villers-Bretonneux (FR)

(73) Assignee: OTOR, Puteaux (FR)

( * ) Notice: Subject to any disclaimer, the term of this patent is extended or adjusted under 35 U.S.C. 154(b) by 0 days.

(21) Appl. No.: 15/116,152

(22) PCT Filed: Feb. 2, 2015

(86) PCT No.: PCT/FR2015/050232

§ 371 (c)(1),
(2) Date: Aug. 2, 2016

(87) PCT Pub. No.: WO2015/114277

PCT Pub. Date: Aug. 6, 2015

(65) Prior Publication Data

US 2016/0362218 A1 Dec. 15, 2016

(30) Foreign Application Priority Data

Feb. 3, 2014 (FR) ..... 14 00297

(51) Int. Cl.
*B65D 5/20* (2006.01)
*B65D 5/22* (2006.01)
*B65D 5/00* (2006.01)

(52) U.S. Cl.
CPC ..... *B65D 5/22* (2013.01); *B65D 5/0025* (2013.01)

(58) Field of Classification Search
USPC ..... 206/740, 743, 744, 745, 748, 557, 503, 206/509, 511
See application file for complete search history.

(56) References Cited

U.S. PATENT DOCUMENTS 2,033,299 A * 3/1936 Reichel ..... B65D 5/38 206/744
7,981,017 B2 * 7/2011 Little ..... B65D 5/445 206/509
2005/0045517 A1 * 3/2005 Holdsworth ..... B65D 5/0035 206/509

(Continued)

FOREIGN PATENT DOCUMENTS

EP 1 746 034 A1 1/2007
EP 2 036 827 A2 3/2009
EP 2 277 785 A1 1/2011

OTHER PUBLICATIONS

International Search Report mailed May 19, 2015, issued in corresponding International Application No. PCT/FR2015/050232, filed Feb. 2, 2015, 2 pages.

(Continued)

*Primary Examiner* — Jacob K Ackun
(74) *Attorney, Agent, or Firm* — Christensen O'Connor Johnson Kindness PLLC

(57) ABSTRACT

A tray made from cardboard sheet material comprising a rectangular base and a ring of side walls, including two opposed first side walls symmetric with respect to a transverse axes of the tray and two second walls, including a second rear wall and a second front wall of lesser height than the other walls.

10 Claims, 7 Drawing Sheets

(56) References Cited

U.S. PATENT DOCUMENTS

2011/0220525 A1* 9/2011 Moss ..... B65D 5/2009
206/386
2014/0326631 A1* 11/2014 Cotie ..... B31B 1/74
206/509

OTHER PUBLICATIONS

Written Opinion of the International Searching Authority mailed May 19, 2015, issued in corresponding International Application No. PCT/FR2015/050232, filed Feb. 2, 2015, 5 pages.

* cited by examiner

TRAY MADE FROM CARDBOARD SHEET MATERIAL FOR MANUAL ASSEMBLY AND BLANK FOR PRODUCING SUCH A TRAY

The present invention relates to a tray made from cardboard sheet material comprising a rectangular base and an enclosure of lateral walls reinforced by pillars formed by folding part of the walls, which tray is designed to be assembled manually.

It also relates to a blank for production of a tray of this type.

It has a particularly advantageous, although not exclusive, application in the field of trays for storage and transport of packaged products of all types (rigid or flexible), the use of which is not limited to transport (requiring good rigidity and good resistance to compression), but is also appropriate for storage and presentation of the products on shelves.

Trays of this type are modular, and thus permit mixing which makes them suitable for the delivery and/or simultaneous promotion of a plurality of different products.

In the case when they are used with a lid, they are easy to open. When they are open at the side, they then allow the products to be seen, and also make them directly accessible to the consumers.

Corrugated cardboard trays are already known (FR 2 747 643) which are provided with corner pillars obtained by folding of end flaps.

Although such trays have good resistance to compression, they do not permit presentation of the products at the sides.

Modular trays are also known (EP 2 036 827) which are provided with support elements which can be connected to the tray from above by means of lateral pillars obtained by folding.

Packaging of this type requires the presence of joining rods, and is thus complicated to implement.

All of these trays are designed to be folded and glued whilst being assembled automatically.

They therefore require investment in costly machines which is not always justified when the quantities required are not very large.

The objective of the present invention is to provide a tray and a blank made of sheet cardboard which comply better than those previously known with the requirements in practice, in particular in that they make it possible to obtain the same advantages of presentation and solidity as trays which are assembled automatically by machines, whilst avoiding their cost and economizing on surface area of cardboard in comparison with the existing trays, up to a level of approximately 20%.

The invention is suitable for use with all sizes of products, with homogenous linear presentation, for point-of-sale promotion or on a pallet, and optimizes the sales space, whilst facilitating access to the products and permitting excellent identification of the brand.

By means of the invention, multiple packaging costs are reduced as a result of the modular nature of the trays which can be stored for different products on a single pallet, and because of their great flexibility as a result of their manual assembly, on demand and without gluing.

Construction of the tray with a double base which permits better resistance to buckling can also be provided, with the possibility of implementing double vertical ribbing on the sides and at the rear of the tray, thus ensuring better resistance to compression and greater stability of the load.

Thus, an optimized ratio of resistance/surface area/weight is obtained, with cardboard which can be entirely recycled, thus reducing the $CO_2$ emissions.

Finally, a tray of this type makes it possible to limit the number of movements for putting into line, whilst eliminating the need for a cutter and/or pre-cutting during putting onto the shelf.

For this purpose, the invention proposes in particular a tray made from cardboard sheet material comprising a rectangular base and an enclosure of lateral walls, i.e. two first opposite lateral walls, known as first walls, which are symmetrical relative to a transverse axis of the tray, and are each provided respectively with at least one reinforcement element which forms a pillar, and two second walls, i.e. a rear second wall and a front second wall which has a shorter height than the other walls, each of the walls being formed by a double panel obtained by edge folding an inner flap on an outer flap, characterized in that the outer flap of the second rear wall is connected to the base by a first folding line, and is connected to the outer flaps of the two first walls by second folding lines perpendicular to the first folding line, the inner flaps of said first walls are connected to said outer flaps, respectively, by a third, double folding line, and the inner flaps of the second walls are connected to the corresponding outer flaps by fourth double folding lines, the respective inner flaps having the same dimensions, or substantially the same dimensions, as the respective outer flaps, their free peripheries opposite said fourth double folding lines being blocked by friction and/or by snapping of lugs together with the upper face and/or corresponding recesses in the base of the tray, and in that the inner flaps of the first walls each comprise a rectangular central panel with a length l which is smaller than the width L of the base, said panel being connected at one of its lateral ends by a fifth folding line to the reinforcement element which forms a pillar provided with an end turned-down piece, said first turned-down piece cooperating with the inner face of the outer flap of the second front wall, said reinforcement element being folded back and blocked relative to said central panel by means of a lateral turned-down piece, said second turned-down piece being connected to the outer flap of the first wall by a sixth double folding line situated on the side opposite the second folding lines.

In advantageous embodiments, in addition and/or moreover, there is recourse to one and/or the other of the following arrangements:

- the reinforcement element is formed by three vertical tongues which are connected to one another by seventh folding lines, the two first tongues forming said pillar, and the third, end tongue being blocked by snapping of a blocking lug which is integral with the second lateral turned-down piece into a recess along the corresponding seventh folding line opposite;
- the side of the outer flap of the first walls comprising the sixth folding line is aslant relative to the vertical on its upper part along said sixth line, and comprises in its lower part a third turned-down piece which is designed to cooperate with the inner face of the corresponding first turned-down piece, the fourth folding line of the second front wall being double;
- on the side opposite the third folding lines, and connected by an eighth folding line, each outer flap of a first wall comprises a lower flap which is folded back onto the upper face of the base of the tray, in order to form a half double base on the tray;
- the two lower flaps forming half double bases comprise means for locking of one with the other;
- the third folding lines and fourth folding line of the second rear wall comprise tenons which are cut out from said third and fourth lines, protruding relative to the corresponding inner flaps, and the base of the tray comprises recesses with a complementary form arranged level with said tenons, for embedding of the tenons of the tray below.

The invention also proposes a blank which makes it possible to obtain a tray as previously described.

The invention thus proposes a blank for constitution of a tray, comprising a rectangular base and an enclosure of lateral walls, i.e. two first opposite lateral walls, known as first walls, which are symmetrical relative to a transverse axis of the tray, and two second walls, i.e. a rear second wall and a front second wall which has a shorter height than the other walls, each of the walls being formed by an inner flap and an outer flap, characterized in that the outer flap of the second rear wall is connected to the base by a first folding line, and is connected to the outer flaps of the two first walls by second folding lines perpendicular to the first folding line, the inner flaps of said first walls are connected to said outer flaps, respectively, by a third, double folding line, and the inner flaps of the second walls are connected to the corresponding outer flaps by fourth double folding lines, the respective inner flaps having the same dimensions, or substantially the same dimensions, as the respective outer flaps, and in that the inner flaps of the first walls each comprise a rectangular central panel with a length which is smaller than the width L of the base, said panel being connected at one of its lateral ends by a fifth folding line to a reinforcement element which forms a pillar when the tray is formed, provided with an end turned-down piece, known as the first turned-down piece, designed to cooperate with the inner face of the outer flap of the second front wall when the tray is formed, said reinforcement element being designed to be folded back and blocked relative to said central panel by means of a lateral turned-down piece, known as the second turned-down piece, connected to the outer flap of the first wall by a sixth double folding line situated on the side opposite the second folding lines.

According to an advantageous embodiment, each outer flap of a first wall comprises, on the side opposite the third folding lines, and connected by an eighth folding line, a lower flap which is folded back onto the upper face of the base of the tray, in order to form a half double base on the tray.

Advantageously, the two lower flaps form a double base comprising means for locking with one another (for example by means of a tenon/mortise).

The invention will be better understood by reading the following description of an embodiment provided hereinafter by way of non-limiting example. The description relates to the drawings which accompany it in which.

Figure 1:
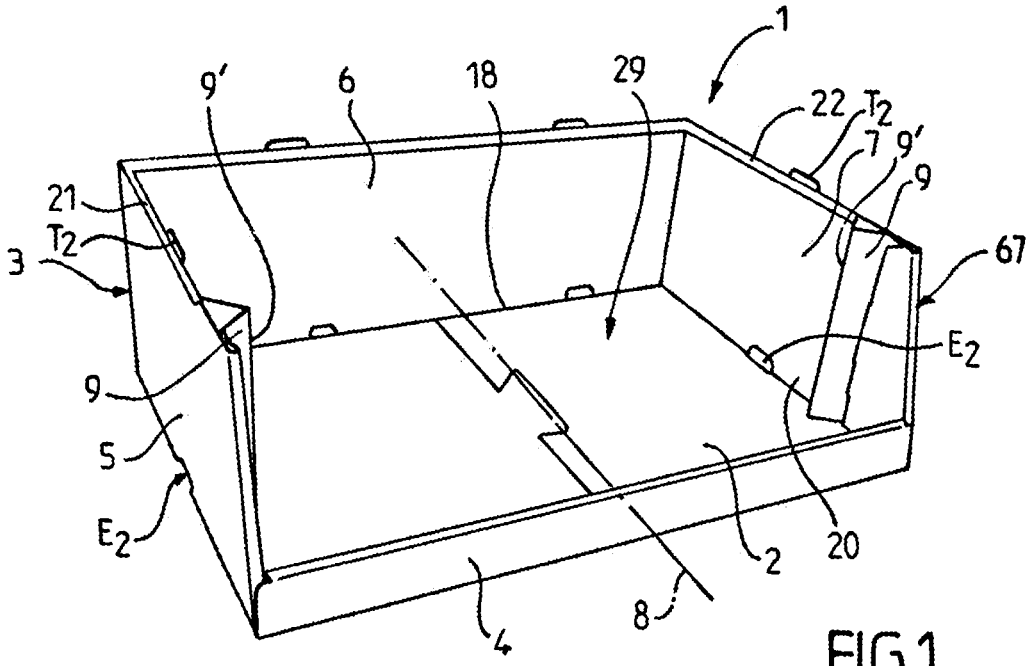
FIG. 1 is a view in perspective of a tray according to an embodiment of the invention.

FIG. 1 shows a tray 1 made from corrugated cardboard sheet material, which for example is 3 mm thick, comprising a rectangular base 2 and an enclosure 3 of rectangular, or substantially rectangular walls, i.e. two first opposite walls 5, 7 and two second opposite walls 4, 6.

The second walls 4, 6 form respectively a front 4 and rear 6 wall.

In the embodiment which is more particularly described here, the first lateral walls 5, 7 are symmetrical relative to a transverse plane of the tray according to an axis 8.

Each of the first walls 5, 7 additionally comprises a reinforcement element 9 which forms a pillar.

The pillar has a substantially triangular base cross-section included in the corresponding wall, and having a vertical ridge 9' which projects inside the tray.

The pillar extends along the entire height of the tray, i.e. the height of the lateral walls 5, 7, or is slightly higher, extending from the top by a few tenths of a millimeter (for example between 0.5 mm and 2.5 mm).

Each pillar 9 is positioned recessed from the front wall 4, i.e. at a distance from the latter of between 5% and 40% of the length concerned of the lateral walls 5, 7.

The front wall 4 is shorter than the three other lateral 5, 7 and rear 6 walls, which have substantially the same height.

The height of the front wall 4 is for example between 1/10 and 1/5 of the total height of the tray (i.e. of the other walls), for example 3 cm for a height of 15 cm.

By this means, the content of the tray 1 is made very accessible.

Each wall 4, 5, 6, 7 is formed by edge folding, i.e. the folding back of one cardboard flap onto another flap with the same dimensions, or substantially the same dimensions, the two being connected to one another by a double folding line, thus forming a double panel wall (or flap).

Figure 2:
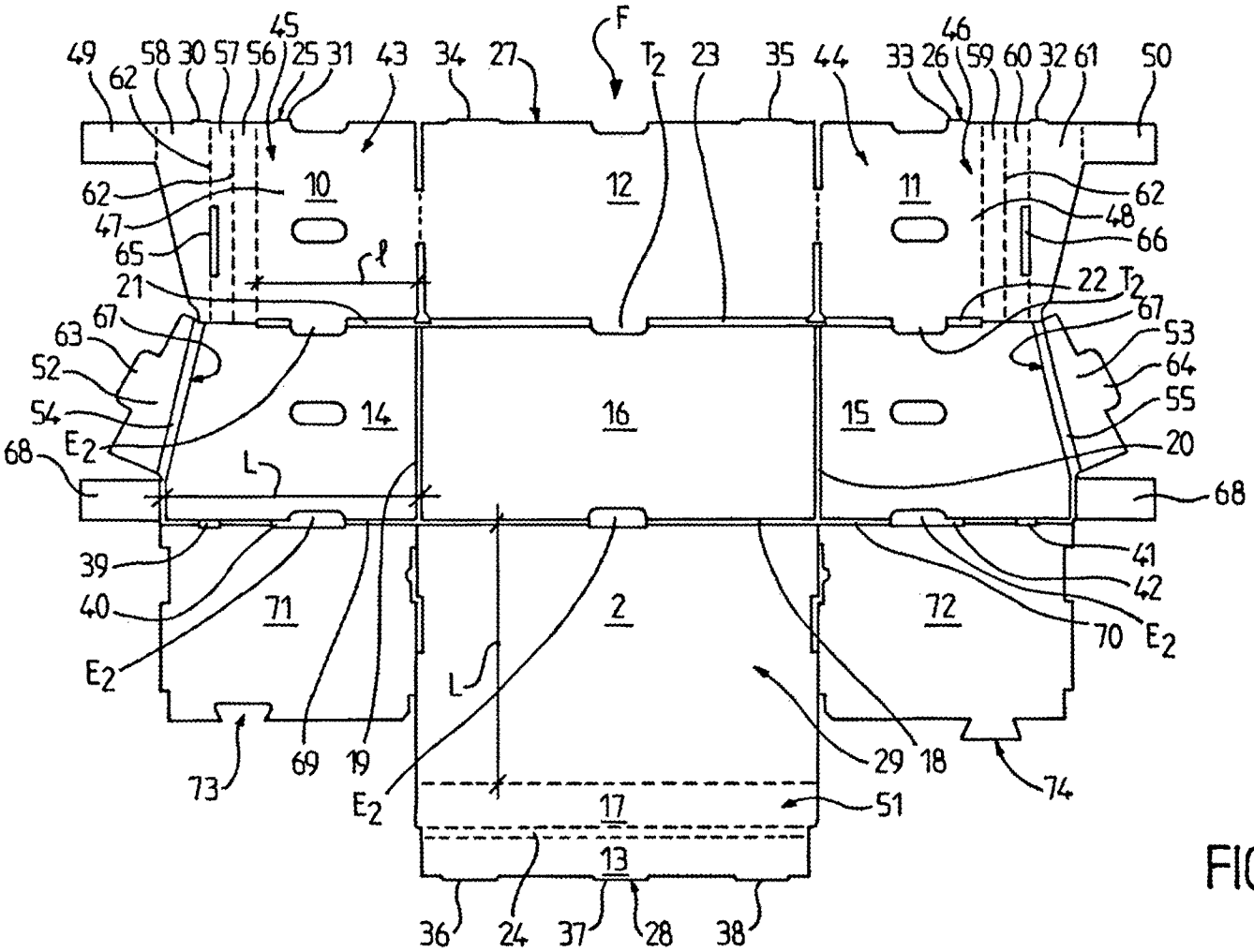
FIG. 2 is a plan view of the blank making it possible to obtain a tray of the type represented in FIG. 1.

More specifically, and with reference to FIG. 2, the tray is formed by folding the blank F. The latter comprises inner flaps 10, 11, 12, 13, i.e. which have a surface facing the interior of the tray, on which there are folded back outer flaps 14, 15, 16, 17 with a form which is identical, or substantially identical, to the corresponding inner flaps.

The outer flap 16 is connected on one side to the base flap 2 by a first folding line 18 (which for example is double), and on both sides to the outer flaps 14, 15 of the two first walls 5, 7 by second folding lines 19, 20.

The second folding lines 19, 20 are perpendicular to the first folding line 18.

The first walls 5, 7 also comprise inner flaps 10, 11, which are connected firstly to the outer flaps 14, 15, respectively, by a third double folding line 21, 22, and secondly (in a precut manner) to the inner flap 12.

The third folding lines 21, 22 comprise tenons Tr which are cut out from said third line, protruding relative to the corresponding inner flaps, the base of the tray comprising recesses Er, which have a complementary form, and are arranged level with said tenons, for embedding of the tenons of the tray below.

The outer flap 16 is connected on the side opposite the base to the inner flap 12 by a fourth double folding line 23, and forms the rear wall 6 by folding back of the inner flap 12 on itself.

The inner flap 13 of the second wall 4, for its part, is connected to the corresponding outer flap 17 by a fourth double folding line 24.

The fourth folding line 23 of the second rear wall also comprises at least one cut out tenon Tr protruding relative to the corresponding inner flap, in this case also the base of the tray, comprising one or more recesses Er with a complementary form arranged level with said tenons, for embedding of the tenons of the tray below.

The respective inner flaps 10, 11, 12, 13 have the same dimensions, or substantially the same dimensions, as the corresponding outer flaps 14, 15, 16, 17.

The inner flaps 10, 11, 12, 13 for their part each comprise a free peripheral edge 25, 26, 27, 28 opposite said fourth double folding lines 21, 22, 23, 24, provided with lugs 30, 31; 32, 33; 34, 35; 36, 37, 38 which project relative to them.

These lugs are blocked by friction and/or by snapping together with the upper face 29 of the base 2, and/or are embedded in corresponding small rectangular recesses 39, 40; 41, 42 in the base 2 of the tray.

The inner flaps 10, 11 of the first walls 5, 7 each comprise a central rectangular panel 43, 44 with a length l which is shorter than the width L of the base 2.

The length l is for example between 200 mm and 380 mm for a width L of between 320 mm and 450 mm, for example 380.

On the side opposite the inner flap 12, the inner flaps and 11 comprise respectively a series of tongues and/or turned-down pieces. In other words the panels 43, 44 are connected respectively at one of their lateral ends 45, 46 by a fifth folding line 47, 48 to the reinforcement element 9 which forms a pillar provided with an end turned-down piece, known as the first turned-down piece 49, 50.

The first turned-down piece 49, 50 is rectangular, for example 80 mm by 30 mm to 160 mm by 110 mm.

The first turned-down piece 49, 50 cooperates with the inner face 51 of the outer flap 17 of the second front wall 4.

The reinforcement element 9, for its part, is folded back and blocked relative to said central panel 43, 44 by means of a trapezoidal lateral turned-down piece, known as the second turned-down piece 52, 53. The latter is connected to the outer flap 14, 15 of the first wall 5, 7 by a sixth double folding line 54, 55, which is situated on the side opposite the second folding lines 19, 20.

The pillar is formed by the succession which consists of a series of three adjacent vertical tongues 56, 57, 58; 59, 60, 61 contained between the inner flaps 10 and 11 and the first turned-down pieces 49, 50.

The two first vertical tongues 56, 57; 59, 60 are rectangular, and the third 58; 61 is constituted by a triangle and/or a trapezium supported on a rectangle.

The three vertical tongues, which have a height equal to, or very slightly greater than, that of the inner flap 12, are connected to one another by seventh folding lines 62.

The two first tongues 56, 57; 59, 60 form the pillar 9, and the third, end tongue 58, 61 is blocked by snapping a blocking lug 63, 64, which is integral with the corresponding second lateral turned-down piece 52, 53 into a recess 65, 66 along the seventh folding line 62 opposite.

The second turned-down piece forms a side 67 of the first walls 5, 7 comprising the sixth folding line 54, 55, which is aslant relative to the vertical on its upper part along said sixth line, and comprising in the lower part a third rectangular turned-down piece 68, which is designed to cooperate with the inner face of the corresponding first turned-down piece 49, 50, the fourth folding line 24 of the second front wall 4 having a thickness corresponding to two thicknesses of the sheet of cardboard.

In the embodiment which is more particularly described here, the base is reinforced.

Each outer flap 14, 15 of a first wall 5, 7 comprises, on the side opposite the third folding lines 21, 22, and connected by an eighth folding line 69, 70, a lower flap 71, 72 which is folded back onto the upper face of the base 2 of the tray, in order to form a half double base on the tray.

The lower flaps 71, 72 have a substantially rectangular form, for example 320 mm by 320 mm to 460 mm by 460 mm.

They are for example substantially symmetrical, with the exception of means 73, 74 for locking with one another, relative to the plane according to the axis 8, and thus each form a half double base of the tray.

The locking means 73, 74 comprises a substantially trapezoidal tenon on the free edge of one of the lower flaps 71, 72, which is designed to cooperate with a groove in the other, in a connection of the dovetail type.

Figure 3:
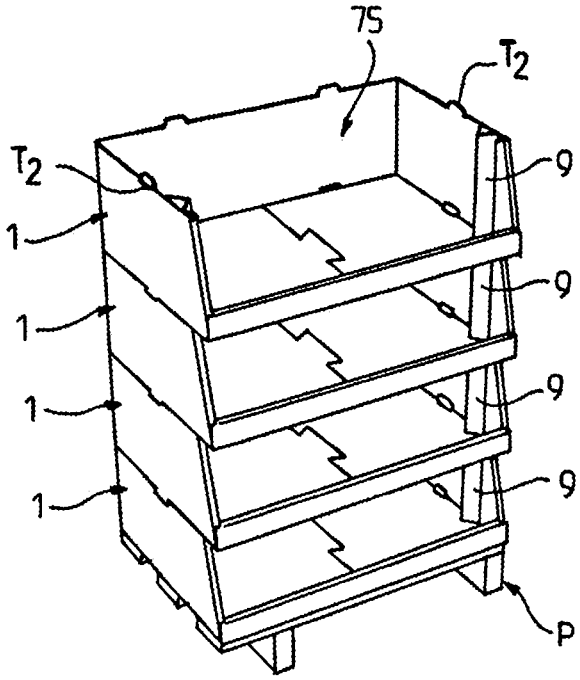
FIGS. 3 and 4 are views in perspective of stacking on pallets of a plurality of trays according to the embodiment in FIG. 1.
Figure 4:
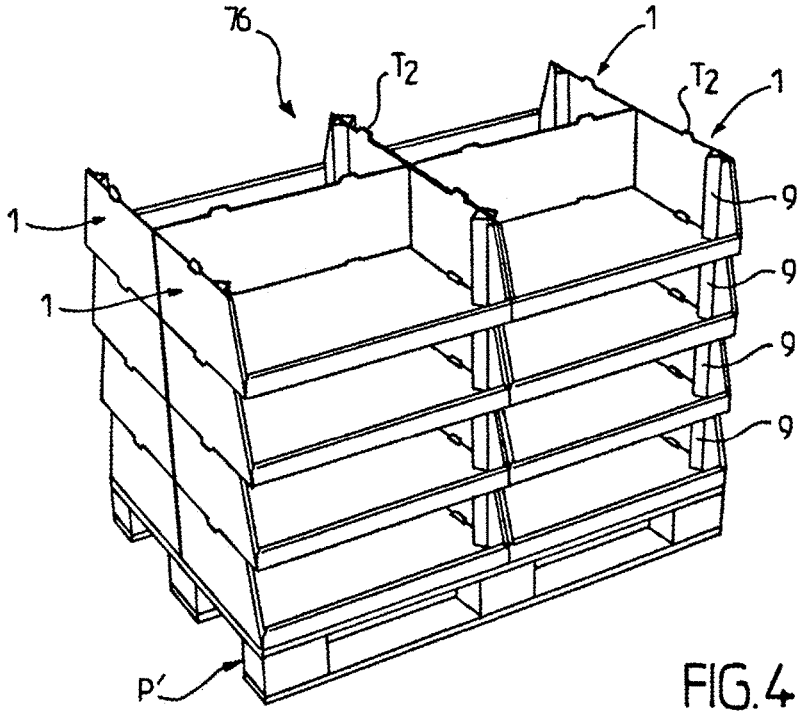

Once the trays 1 have been formed, they can be stacked as represented in FIGS. 3 and 4.

Since their structure has good resistance to compression, their dimensions can be adapted to occupy a quarter of a pallet P (FIG. 3) or a whole pallet in quarters (FIG. 4) without additional means for retention of a stack of trays.

During the superimposition of the trays, the tenons Tr of the tray below extend from the corresponding wall 5, 7 in order to form a connection of the mortise type, by being embedded in the complementary recesses Er which form an opening in the tray above.

In another embodiment, the blank also comprises openings with a form complementary to the turned-down pieces of the reinforcement pillar on the eighth folding line, designed to cooperate with the excess height of said pillar.

The manual assembly of a tray from the blank according to an embodiment of the invention will now be described more particularly with reference to FIGS. 5A to 5J.

Figure 5A:
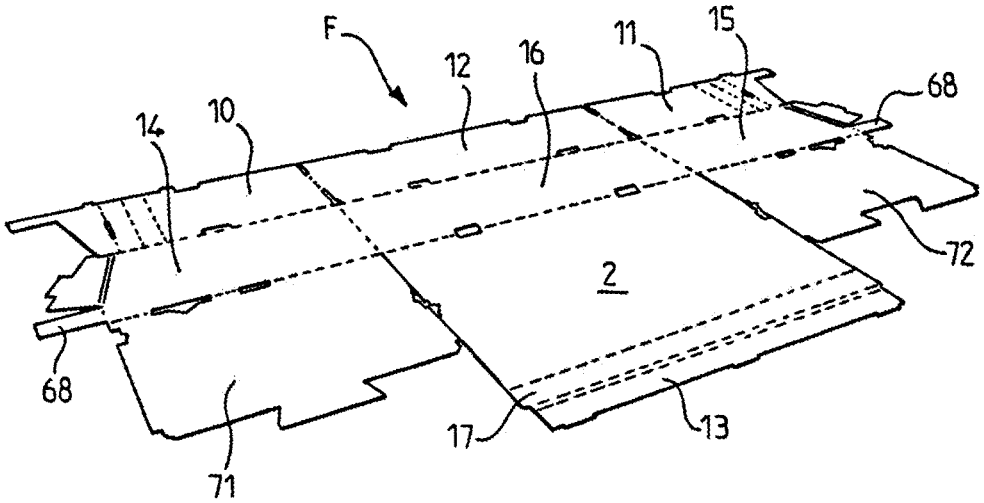
FIGS. 5A to 5J show the steps of manual assembly of the tray in FIG. 1 from a blank of the type in FIG. 2.
Figure 5B:
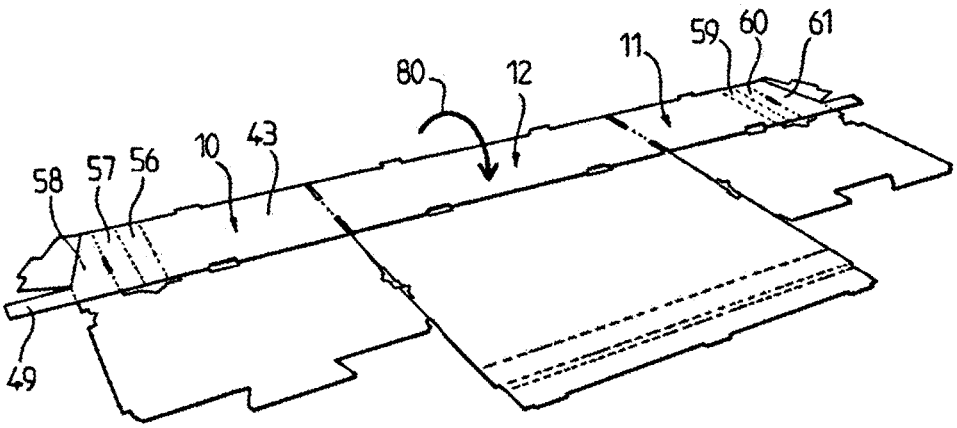
Figure 5C:
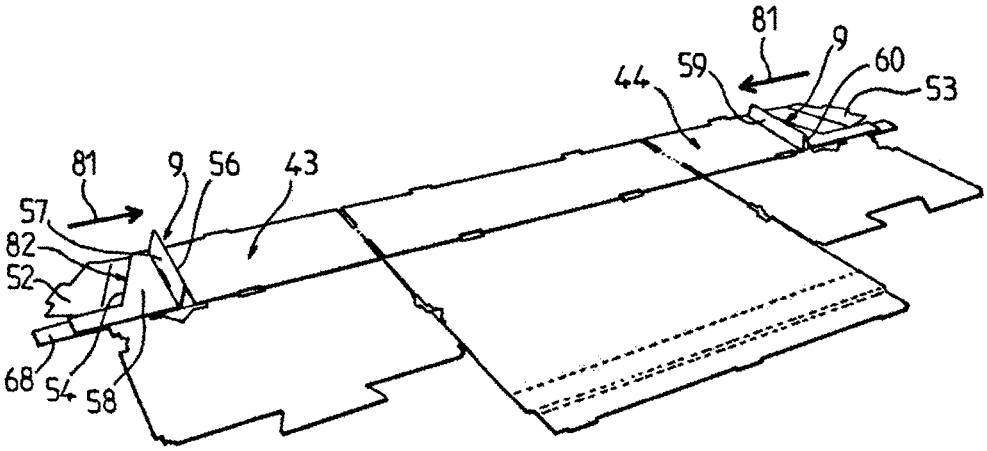

FIG. 5A shows the first step of assembly of the tray, consisting of the supply of a flat unfolded blank F.

In a second step (FIG. 5B) the operator folds the inner flaps 10, 11, 12 back around their folding line 22, 23 in order to form the edge folding of the inner flaps on the outer flaps.

The folding is carried out at 180°, such that the faces of the flaps are in contact.

The operator then makes the ridge of the reinforcement pillar 9 project (arrows 81) (step three, FIG. 5C), in order to form a dihedron. For this purpose, the operator exerts force on the plane of the blank, and thrusts in the inner direction of the blank as represented by the arrows 81.

This operation is carried out for example by placing a hand on both sides of the vertical tongues 56, 57; 59, 60 on the flaps 10, 58; 11, 61.

The operator presses on the vertical tongues 56, 57;

59, 60, and retains the reinforcement 9 in the form of a pyramid with a base on the corresponding blanks which is smaller than that required.

In other words, he retains the pyramids with an angle at the top which is smaller than the final angle, or angle of stability.

The free edge 82 which is oblique on the plane of the blank with the vertical tongues 58, 60 then corresponds substantially to the sixth folding lines 54, 55.

The third turned-down pieces 68 then extend beyond the first turned-down pieces 49, 50, as well as the second turned-down pieces 52, 53 (which extend opposite).

Figure 5F:
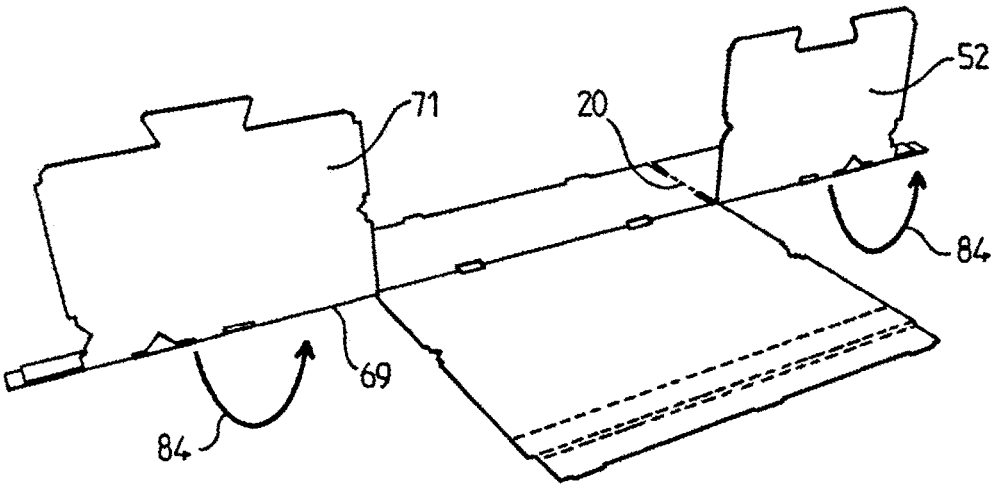
Figure 5G:
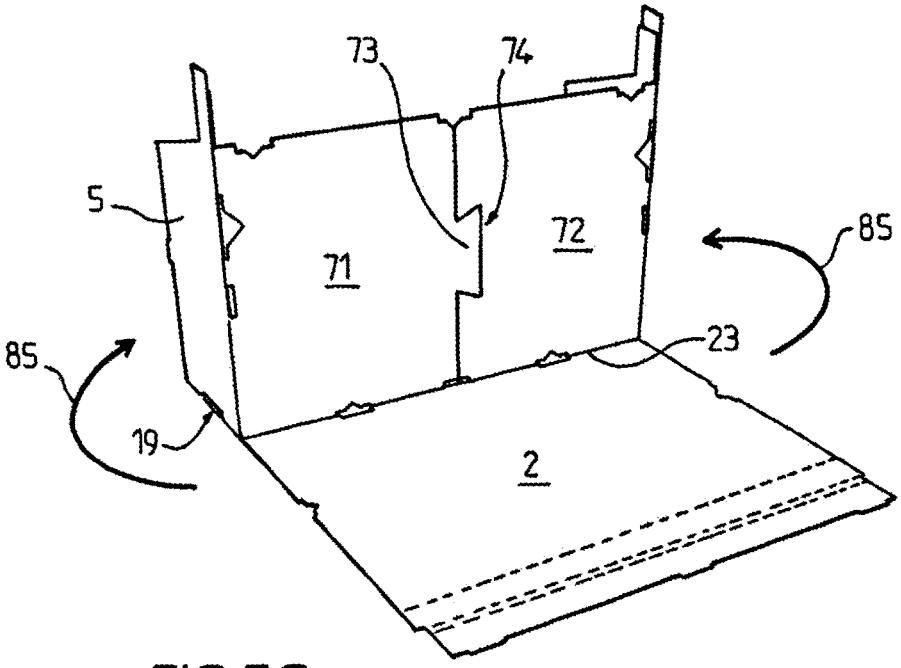
Figure 5D:
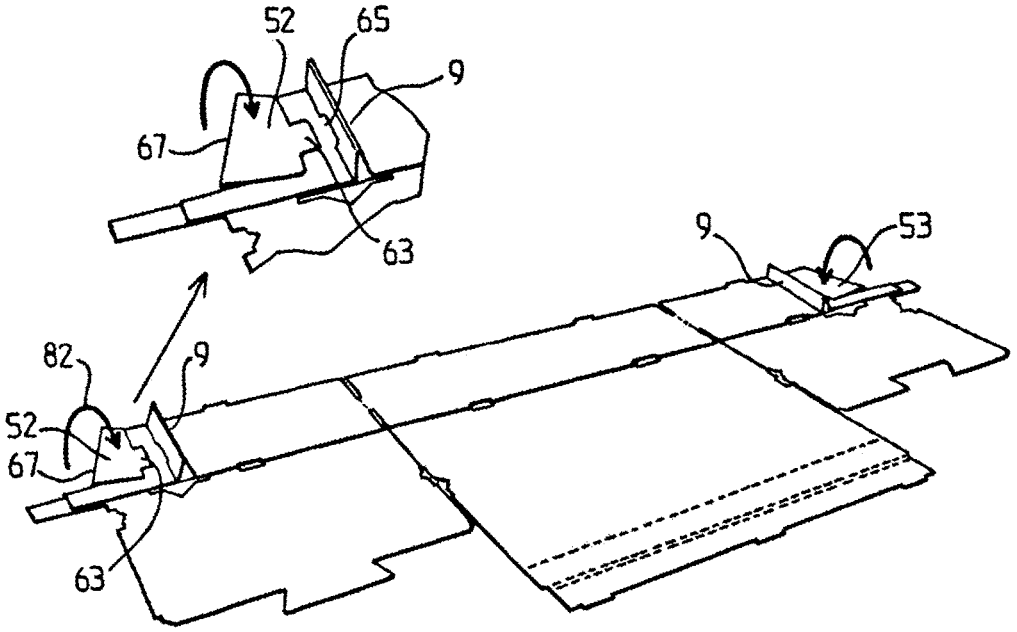

With reference to FIG. 5D, the second, substantially triangular turned-down pieces 52, 53 are then folded back at 180° according to the sixth oblique folding lines 67 on the vertical tongues 58, 61 which have previously been folded back (arrows 82).

Figure 5E:
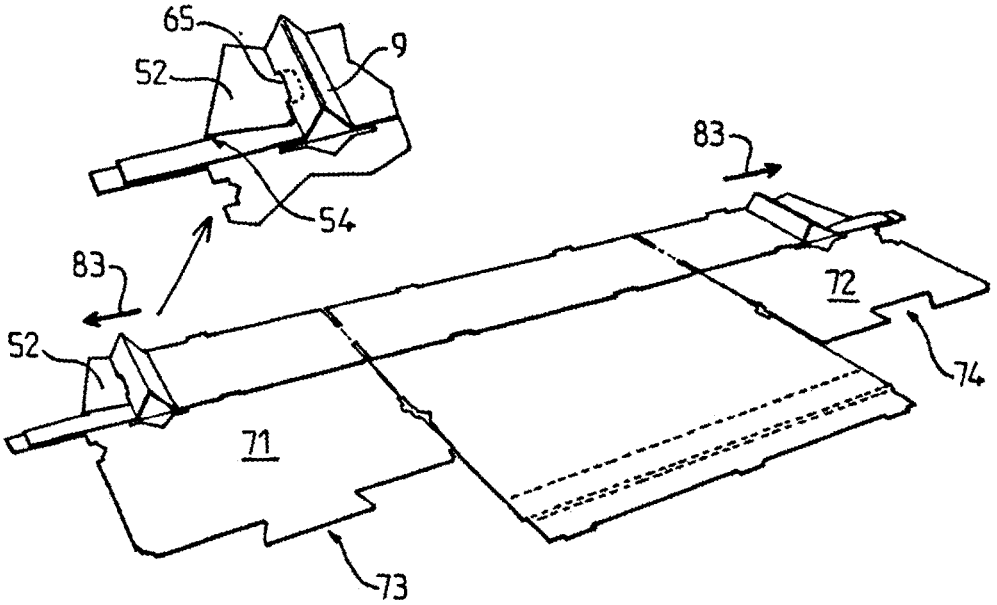

The operator then releases the pressure on the reinforcement 9, and by spring effect of the cardboard and/or by traction by the operator in the direction which is the inverse of that for constitution of the reinforcement (arrows 83) spaces the base from the reinforcement 9 (step five, FIG. 5E).

The operator holds steady and/or guides the lugs 63, 64 in order to block them by snapping in and embedding integrally with the second lateral turned-down piece 52, 53 in the respective recess 65, 66 along the seventh folding line 54, 55 when they are opposite.

The operator then folds back (arrows 84) the lower flaps 71, 72, with an angle of 90° relative to the remainder of the blank, according to the eighth folding lines 69 (step six, FIG. 5F).

Then, by means of folding (arrows 85) around second folding lines 19, 20, by an angle of approximately 90°, the operator brings the lower flaps 71, 72 towards one another, and brings the locking means (73, 74) into the blocking position, in order to form a double base on the tray (step seven, FIG. 5G).

The tenon 73 is then inserted in the groove 74 in order to form the swallowtail connection.

Figure 5H:
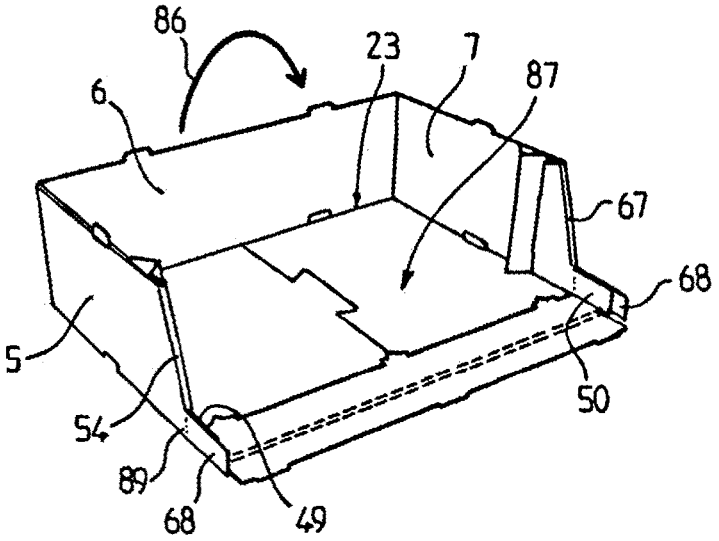
Figure 5I:
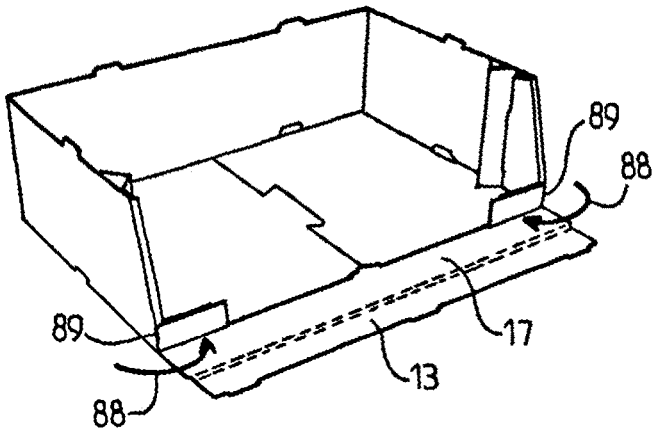

The operator then pivots (arrows 86) the assembly by folding by 90° on the base 2 according to the first folding line in order to form the reinforced base 87 of the tray 1 (step eight, FIG. 5H).

All of the first and third turned-down pieces 49, 68; 50, 68 are then folded back by 90° towards the interior of the tray (arrows 88) according to the ninth folding line 89 (step nine, FIG. 51).

Figure 5J:
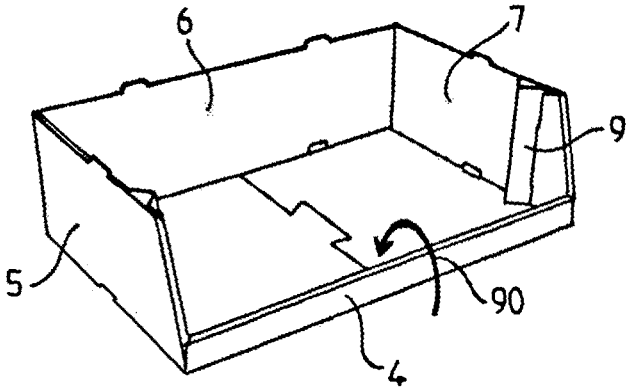

The operator completes the assembly of the tray by edge folding the front face 4, i.e. by folding back by 180° (arrows 90) the inner face 13 onto the outer face 17 according to the fourth double folding line 24, and by folding the assembly back by 90° in order to form the front face (step ten, FIG. 5J).

The assembly is rendered integral by friction and/or clipping of the edges 30, 31, 32, 33, 34, 35 etc. together with the base and/or corresponding recesses.

As will be appreciated, and is apparent from the foregoing description, the present invention is not limited to the embodiments more particularly described.

On the contrary, it incorporates all the variants, and in particular those in which the folding lines are double, and/or those in which they comprise a cardboard tongue between two folding lines.

The invention claimed is:

1. A tray made from cardboard sheet material comprising a rectangular base and an enclosure of two first opposite lateral first walls, which are symmetrical relative to a transverse axis of the tray, and are each provided respectively with at least one reinforcement element which forms a pillar, and second front and rear walls, the front second wall having a shorter height than the other walls, each of the walls being formed by a double panel obtained by edge folding an inner flap on an outer flap, wherein the outer flap of the second rear wall is connected to the base by a first folding line, and is connected to the outer flaps of the two first walls by second folding lines perpendicular to the first folding lines, the inner flaps of said first walls are connected to said outer flaps, respectively, by a third, double folding line, and the inner flaps of the second walls are connected to the corresponding outer flaps by fourth double folding lines, the respective inner flaps having the same dimensions, or substantially the same dimensions, as the respective outer flaps, their free peripheries opposite said fourth double folding lines being blocked by friction and/or by snapping of lugs together with the upper face and/or corresponding recesses in the base of the tray, wherein the inner flaps of the first walls each comprise a rectangular central panel with a length l which is smaller than the width L of the base, said panel being connected at one of its lateral ends by a fifth folding line to the reinforcement element which forms a pillar provided with a first turned-down piece cooperating with the inner face of the outer flap of the second front wall, said reinforcement element being folded back and blocked relative to said central panel by a second turned-down piece connected to the outer flap of the first wall by a sixth double folding line situated on the side opposite the second folding lines.

2. The tray as claimed in claim 1, wherein the reinforcement element is formed by three vertical tongues which are connected to one another by seventh folding lines, the two first tongues forming said pillar, and the third, end tongue being blocked by snapping of a blocking lug which is integral with the corresponding second turned-down piece into a recess along the seventh folding line when it is opposite.

3. The tray as claimed in claim 1, wherein the side of the outer flap of the first walls comprising the sixth folding line is aslant relative to the vertical on its upper part along said sixth line, and comprises in its lower part a third turned-down piece which is designed to cooperate with the inner face of the corresponding first turned-down piece, the fourth folding line of the second front wall being double.

4. The tray as claimed in claim 1, wherein, on the side opposite the third folding lines, and connected by an eighth folding line, each outer flap of a first wall comprises a lower flap which is folded back onto the upper face of the base of the tray, in order to form a half double base on the tray.

5. The tray as claimed in claim 4, wherein the two lower flaps forming half double bases comprise means for locking of one with the other.

6. The tray as claimed in claim 1, wherein the third folding lines and fourth folding line of the second rear wall comprise tenons which are cut out from said third and fourth lines, protruding relative to the corresponding inner flaps, and the base of the tray comprises recesses with a complementary form arranged level with said tenons, for embedding of the tenons of a tray below.

7. A blank for constitution of a tray, comprising a rectangular base and an enclosure two opposite lateral first walls, which are symmetrical relative to a transverse axis of the tray, and front and rear second walls, the front second wall having a shorter height than the other walls, each of the walls being formed by an inner flap and an outer flap, wherein the outer flap of the second rear wall is connected to the base by a first folding line, and is connected to the outer flaps of the two first walls by second folding lines perpendicular to the first folding line, the inner flaps of said first walls are connected to said outer flaps, respectively, by a third, double folding line, and the inner flaps of the second walls are connected to the corresponding outer flaps by fourth double folding lines, the respective inner flaps having the same dimensions, or substantially the same dimensions, as the respective outer flaps, wherein the inner flaps of the first walls each comprise a rectangular central panel with a length l which is smaller than the width L of the base, said panel being connected at one of its lateral ends by a fifth folding line to a reinforcement element which forms a pillar when the tray is formed, provided with a first turned-down piece, designed to cooperate with the inner face of the outer flap of the second front wall when the tray is formed, said reinforcement element being designed to be folded back and blocked relative to said central panel by a second turned-down piece connected to the outer flap of the first wall by a sixth double folding line situated on the side opposite the second folding lines.

8. The blank as claimed in claim 7, wherein the reinforcement element is formed by three vertical tongues which are connected to one another by seventh folding lines, the two first tongues forming said pillar, and the third, end tongue being designed to be blocked by snapping of a blocking lug which is integral with the second turned-down piece into a recess along the seventh folding line when it is opposite.

9. The blank as claimed in claim 7, wherein each outer flap of a first wall comprises, on the side opposite the third folding lines, and connected by an eighth folding line, a lower flap which is designed to be folded back onto the upper face of the base of the tray, in order to form a half double base on the tray.

10. The blank as claimed in claim 7, wherein the side of the outer flap of the first walls comprising the sixth folding line is aslant on its upper part along said sixth folding line, and comprises in its lower part a third turned-down piece which is designed to cooperate with the inner face of the corresponding first turned-down piece, the fourth folding line of the second front wall being double.

* * * * *